US008186537B2

(12) United States Patent
Rosnak et al.

(10) Patent No.: US 8,186,537 B2
(45) Date of Patent: May 29, 2012

(54) VENTED CLOSURE FOR CONTAINER

(75) Inventors: Robert Rosnak, North Tonawanda, NY (US); Son Luong, Cranston, RI (US); Daniel Nelsen, East Greenwich, RI (US); Michael C. Pereira, Smithfield, RI (US); Troy Schubert, Groveland, MA (US); Daniel Smith, Portsmouth, RI (US)

(73) Assignee: Gerber Products Company, Fremont, MI (US)

( * ) Notice: Subject to any disclaimer, the term of this patent is extended or adjusted under 35 U.S.C. 154(b) by 85 days.

(21) Appl. No.: 12/446,495

(22) PCT Filed: Aug. 31, 2007

(86) PCT No.: PCT/US2007/077339

§ 371 (c)(1), (2), (4) Date: Nov. 17, 2010

(87) PCT Pub. No.: WO2008/030767

PCT Pub. Date: Mar. 13, 2008

(65) Prior Publication Data

US 2011/0049169 A1 Mar. 3, 2011

Related U.S. Application Data

(60) Provisional application No. 60/824,526, filed on Sep. 5, 2006.

(51) Int. Cl.
*A47G 19/22* (2006.01)
*B65D 25/38* (2006.01)

(52) U.S. Cl. ..... 220/705; 220/709

(58) Field of Classification Search ..... 220/705, 220/709; D7/300.2
See application file for complete search history.

(56) References Cited

U.S. PATENT DOCUMENTS

| | | | | |
|---|---|---|---|---|
| 2,752,199 | A | 6/1956 | Newell, Jr. et al. | |
| 3,438,527 | A * | 4/1969 | Berry, Jr. | 215/388 |
| 4,513,891 | A | 4/1985 | Hain et al. | |
| 5,301,845 | A | 4/1994 | Labonte | |
| 5,337,918 | A * | 8/1994 | Wang | 220/708 |

(Continued)

FOREIGN PATENT DOCUMENTS

WO WO 99-59893 11/1999

*Primary Examiner* — Mickey Yu
*Assistant Examiner* — Niki Eloshway
(74) *Attorney, Agent, or Firm* — Connolly Bove Lodge & Hutz LLP

(57) ABSTRACT

A vented closure is provided for use on a liquid container. The body of the closure (16) includes a dispensing port and a vent (28) extending therethrough with the vent adjacent the dispensing port (26). The tube (32) extends through the dispensing port (26) and has a flange (38) extending laterally therefrom, engaging the outer surface (20) of the closure body. A flexible seal (40) member is positioned on the tube (32), spaced from the inner surface (28) and having a frusto-conical shape where the inner end (40*a*) of the member is formed at the tube (32). The outer end (40*b*) is spaced away from the tube (32) and engages the inner surface (28) of the closure body (16), forming a hollow area (41) between the member (40) and the tube (32). The flexible seal member (40) is movable radially away from the tube (32) and away from the inner surface (28) to the inflow of air through the vent and over the flexible seal member (40).

10 Claims, 7 Drawing Sheets

U.S. PATENT DOCUMENTS

| | | | | |
|---|---|---|---|---|
| 5,497,907 | A * | 3/1996 | Gmuer et al. | 222/58 |
| 5,560,513 | A * | 10/1996 | Jarrell | 220/705 |
| 6,116,446 | A * | 9/2000 | Haughton et al. | 215/355 |
| 6,196,413 | B1 | 3/2001 | Tung | |
| 6,243,339 | B1 * | 6/2001 | Spruit et al. | 369/53.13 |
| 6,290,090 | B1 * | 9/2001 | Essebaggers | 220/710 |
| 629,135 | A1 | 8/2005 | Nixon et al. | |
| 6,929,135 | B1 * | 8/2005 | Hajianpour | 215/229 |
| 7,204,382 | B2 * | 4/2007 | Cezeaux | 215/229 |
| D543,767 | S * | 6/2007 | Mather et al. | D7/300.2 |
| 7,703,634 | B2 * | 4/2010 | Rohrig | 220/714 |
| 7,798,360 | B2 * | 9/2010 | Roberts | 220/710 |
| 2009/0255944 | A1 * | 10/2009 | Yamashita et al. | 220/705 |
| 2010/0127005 | A1 * | 5/2010 | Sanbrook et al. | 220/705 |

* cited by examiner

VENTED CLOSURE FOR CONTAINER

CROSS REFERENCE TO RELATED APPLICATIONS

This application is a National Stage of PCT/US2007/077339 filed Aug. 31, 2007 which in turn claims priority from U.S. Provisional Application 60/824,526 filed Sep. 5, 2006, the entire contents of which are incorporated herein by reference.

FIELD OF THE INVENTION

The present invention relates to vented closures for liquid containers.

BACKGROUND OF THE INVENTION

Liquid containers have various types of closures. Some closures have tubes, such as straws, for withdrawing liquid from the container. When liquid is withdrawn from the container, through the tube, a negative pressure may be created within the container, thus making it more difficult to further withdraw liquid. To address this problem, various types of vents have been used to allow air into the container and equalize the pressure between the inside of the container and the outside atmosphere.

In addition to equalizing the relative pressure within a container, it may also be desirable to prevent liquid from escaping the container through the vent, if the container is tilted or knocked over. It would be beneficial to provide a vented closure for a container that allowed pressure equalizing air to enter the container and restricted unwanted outward flow of liquid from the container.

BRIEF SUMMARY OF THE INVENTION

The present invention relates to vented closures for liquid containers. The vented closure is provided on a liquid container. The body of the closure includes a dispensing port extending therethrough and a vent opening positioned adjacent the dispensing port. The tube extends through the dispensing port and has a flange extending laterally therefrom, engaging the outer surface of the closure body. A flexible seal member is positioned on the tube, spaced from the inner surface. The flexible seal member has a frusto-conical shape where the inner end of the flexible seal member is formed at the tube. The outer end is spaced away from the tube and engages the inner surface of the closure body, forming a hollow area between the flexible seal member and the tube. In response to a pressure differential across the vent, the flexible seal member is movable radially away from the tube and away from the inner surface. The movement of the flexible seal member allows the inflow of air through the vent and between the inner surface and the outer end of the flexible seal member, to equalize the pressure in the container.

In a further aspect of the invention, a drinking container is in the form of a cup and the vented closure is a lid that is attachable to the cup. In a further aspect of the invention, the tube comprises a straw portion that extends outwardly from the closure. The straw is preferably formed from a flexible material.

BRIEF DESCRIPTION OF THE DRAWINGS

For the purpose of illustrating the invention, the drawings show forms of the invention that are presently preferred.

However, it should be understood that this invention is not limited to the precise arrangements and instrumentalities shown in the drawings.

DETAILED DESCRIPTION OF THE DRAWINGS

Figure 1:
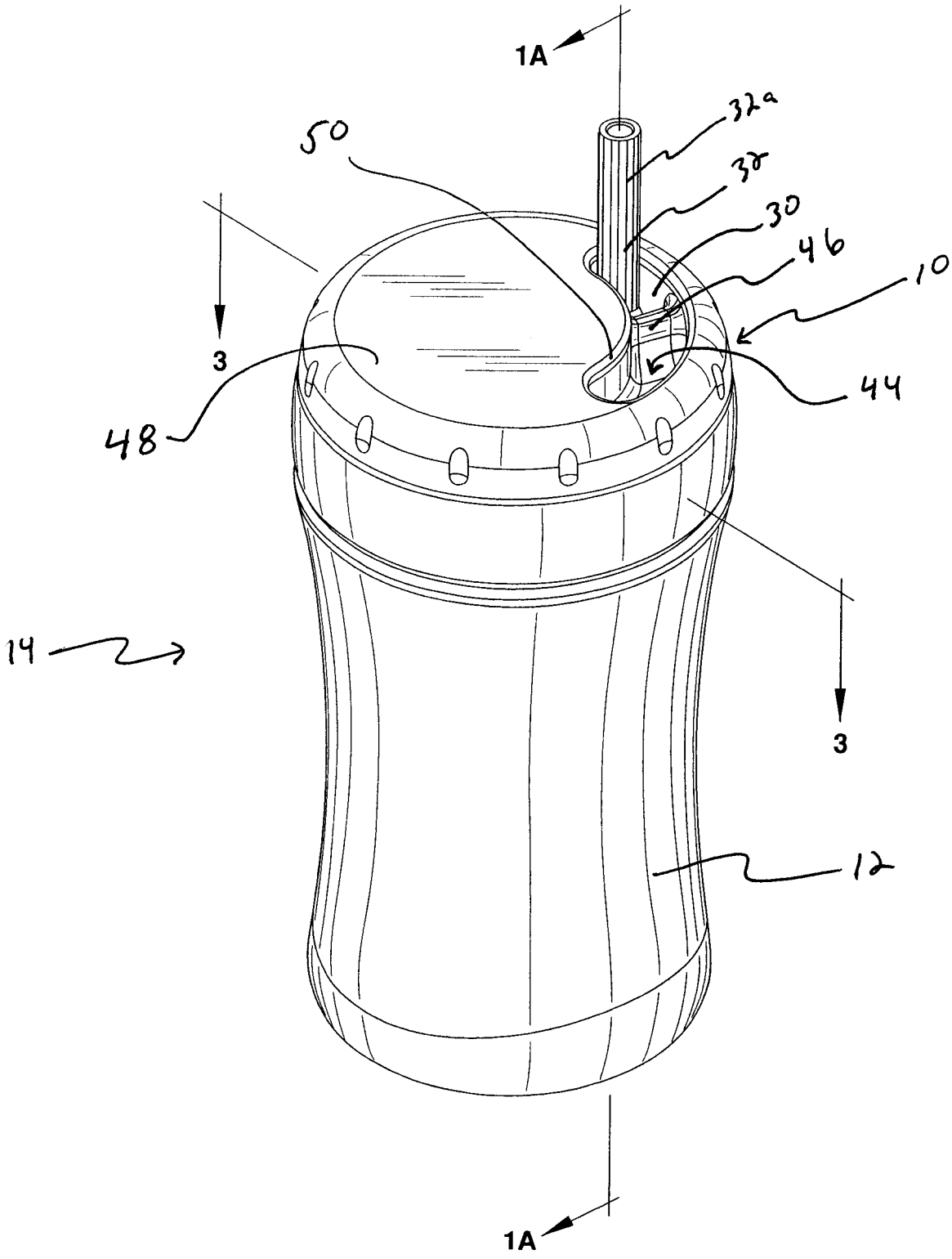
FIG. 1 is a perspective view of a container having a vented closure according to an embodiment of the present invention.

Referring now to the drawings where like numerals indicate like elements, there is shown an exemplary embodiment of a vented closure according to the present invention, which is generally referred to by the numeral 10. The vented closure is primarily used in connection with containers for drinking liquids. However, the vented closure 10 may be used with containers for various other liquids and applications where it is desirable to allow flow of air into a container while preventing liquid from escaping. Such applications could be spray bottles, squeeze bottles or other dispensing containers for liquids. The vented closure may be used with liquids such as water, juices, shampoo, bleach, oil, medicaments or any other liquid. It should be understood that the directions up and down, as used herein, refer only to those directions when viewing the Figures, and are not intended to limit the placement or functionality of the vented closure 10.

Figure 1A:
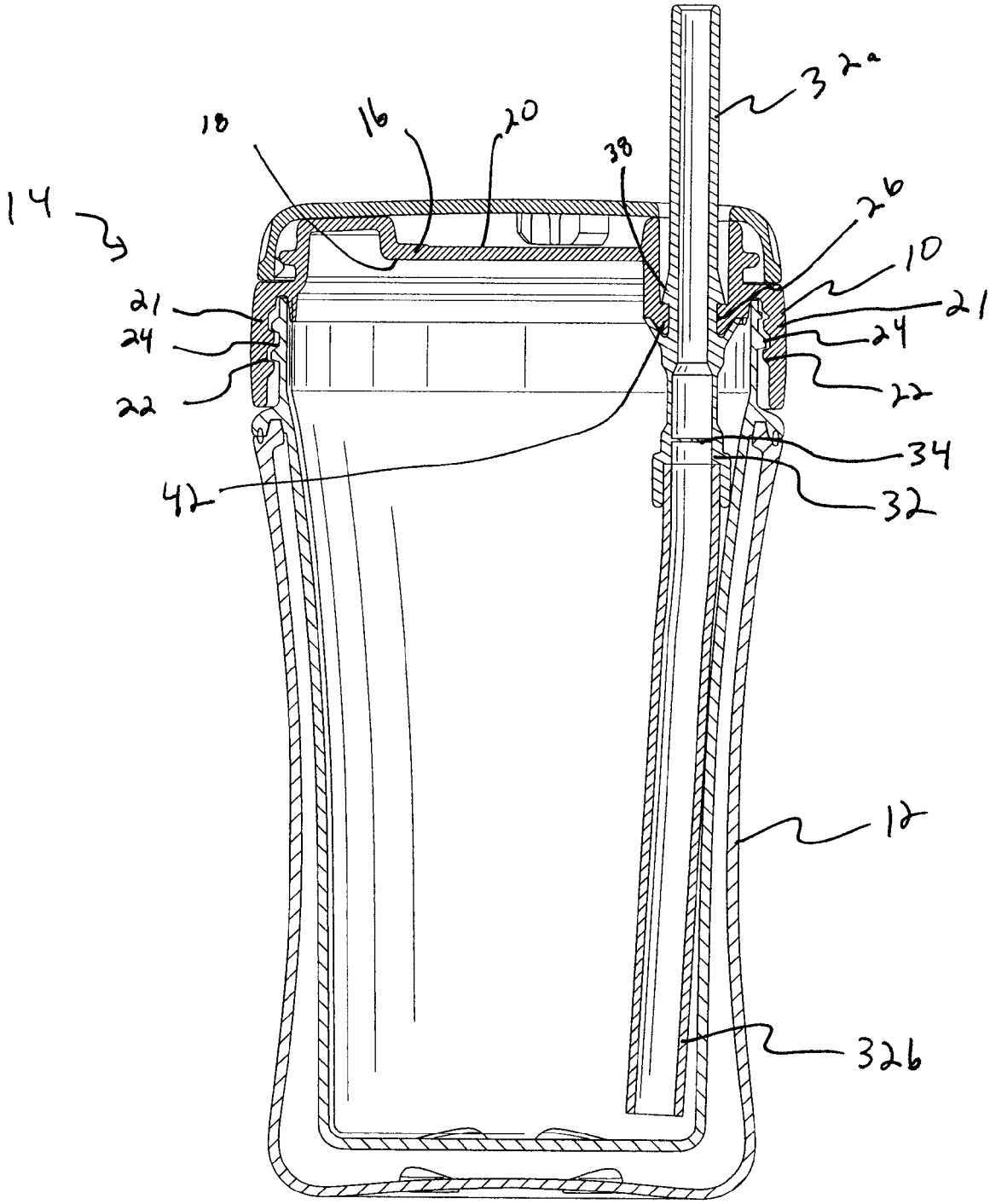
FIG. 1*a* is a cross-sectional view the container and closure shown in FIG. 1, taken along the line 1*a*-1*a*.

As shown in FIGS. 1 and 1*a*, the vented closure 10 is used in connection with a cup 12 to form a liquid container 14 or some other vessel. The vented closure 10 has a closure body 16 which spans the open end of the cup 12. The closure body 16 includes an inner surface 18 and an outer surface 20. A downwardly extending annular rim 21 is located around the perimeter of the inner surface 20. Female threads 22 are located on the interior of the annular flange 21 and engage male threads 24 located around the perimeter of the cup 12. The threads 24 and 22 may be reversed, such that the male threads 24 are located on the rim 21 and the female threads 22 are located on the cup 12. Although threads are shown here, the closure body 16 may be releasably retained to the cup 14 through any known means, such as a snap fit, frictional engagement, a press fit, or any other type of suitable engagement.

Figure 2:
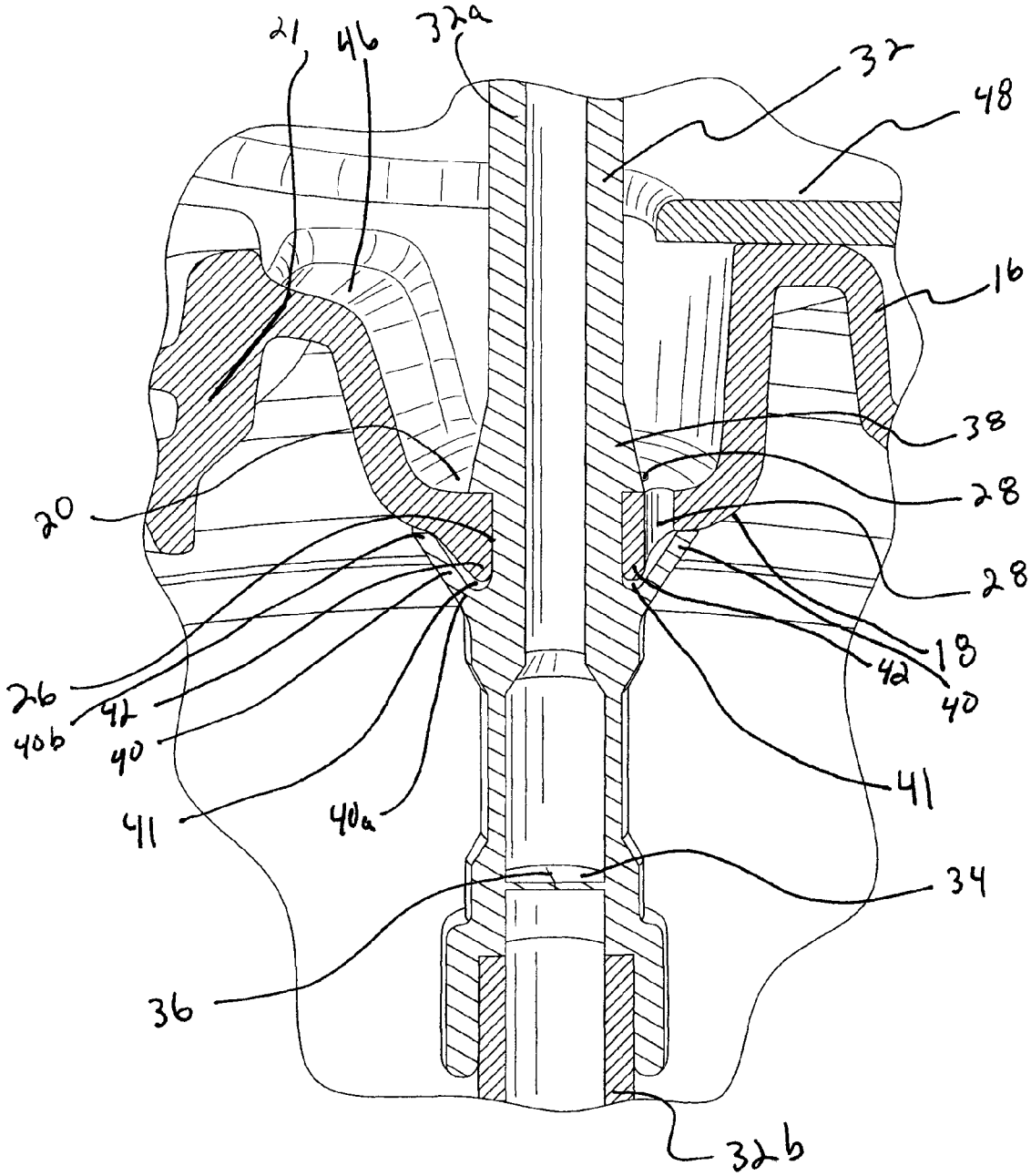
FIG. 2 is an enlarged cross-sectional view of the vented closure embodiment shown in FIG. 1.
Figure 2A:
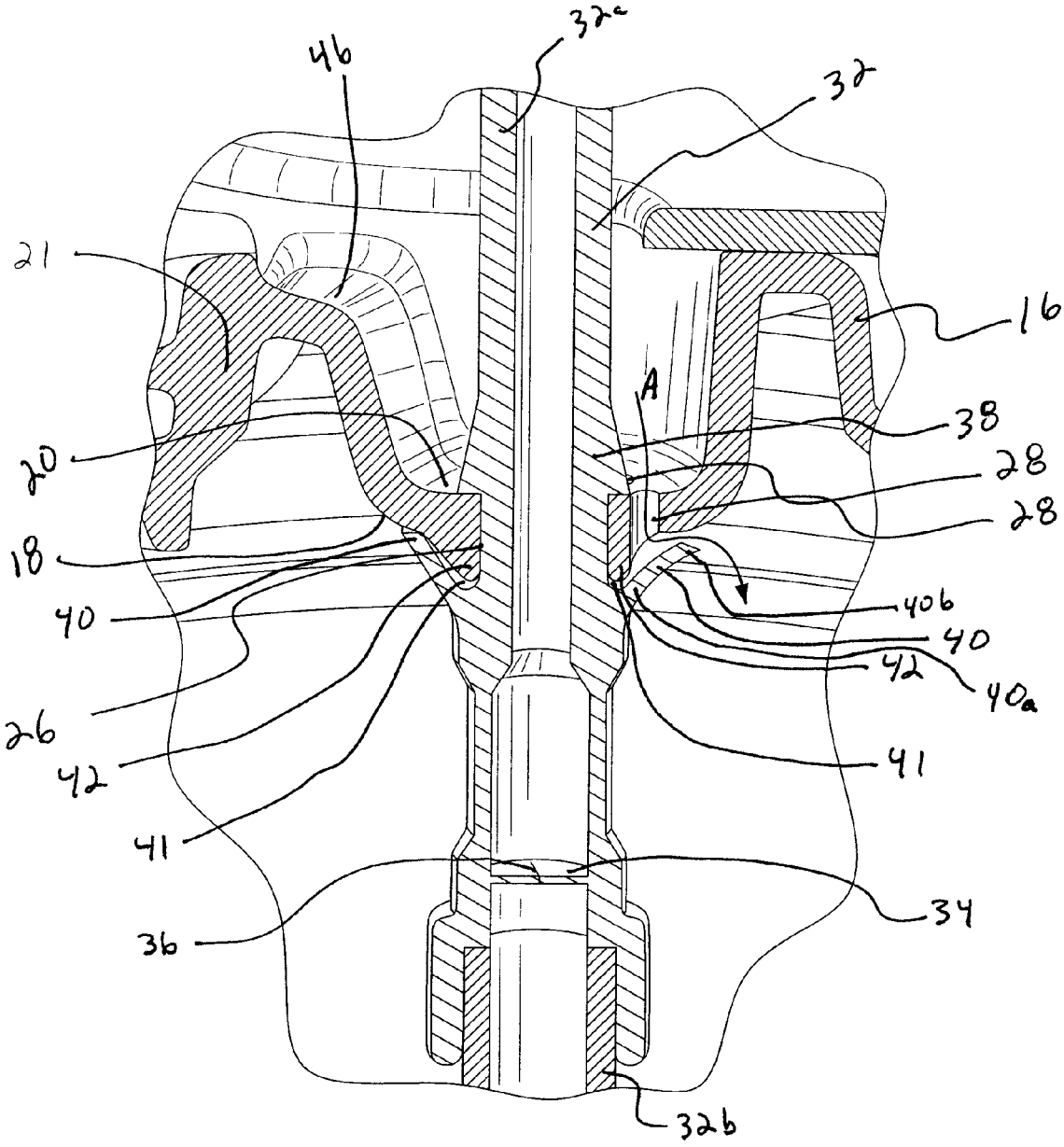
FIG. 2*a* is an enlarged cross-sectional view of the vented closure of FIG. 2 shown in an alternate operative position.

Referring now to FIGS. 2 and 2*a*, a dispensing port 26 and vents 28 extend through the closure body 16. The dispensing port 26 and vents 28 are located in a bowl shaped section 30 of the closure body 16. In the embodiment shown, the dispensing port 26 and vents 28 are generally parallel to each other; however, they may be arranged in a variety of relationships.

A tube 32 extends through the dispensing port 26. In the embodiment shown, the tube 32 comprises an upper tube portion 32*a*, extending from just inside the closure 10, through the dispensing port 26, and outwardly of the closure 10. The tube 32 also has a lower tube portion 32*b*, extending downwardly from the upper tube portion 32*a*, towards the bottom of the cup 12. The tube 32 may include a valve 34, adapted to restrict the flow of liquid through the tube 32. The valve 34 shown here is constructed of a resiliently flexible material and spans the interior of the tube with at least one slit 36 extending therethrough.

Figure 3:
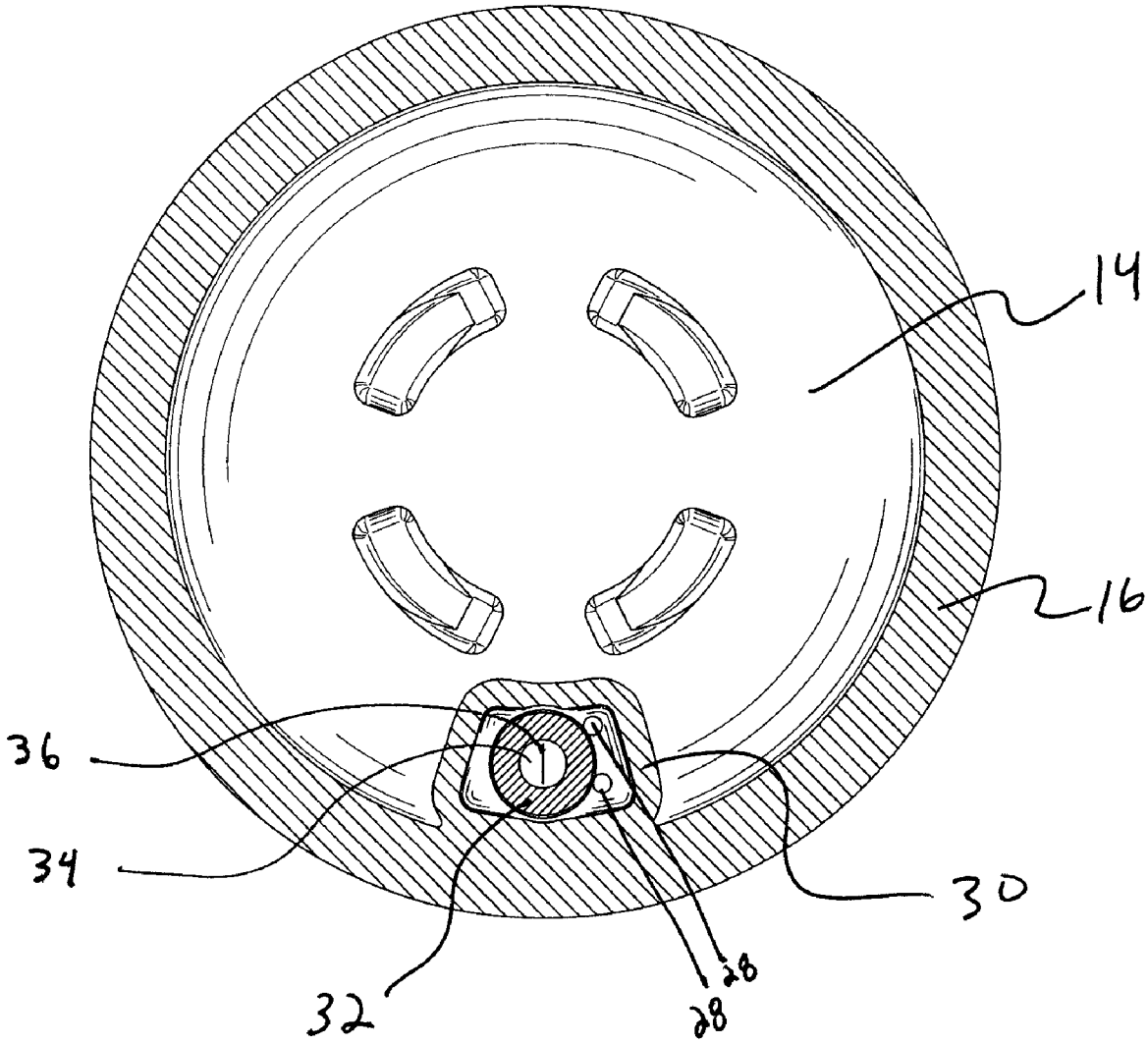
FIG. 3 is a further cross-sectional view of the container and closure, taken along the line 3-3, in FIG. 1.

FIG. 3 shows a top view of the relative positioning of the vents 28 and the tube 32 within the bowl shaped section 30 of the container 14. The vents 28 are located adjacent the tube, but they are not covered by any part of the tube 32. It is preferable, but not necessary that the tube 32 and vents 28 be located adjacent an edge of the container 14.

Figure 4:
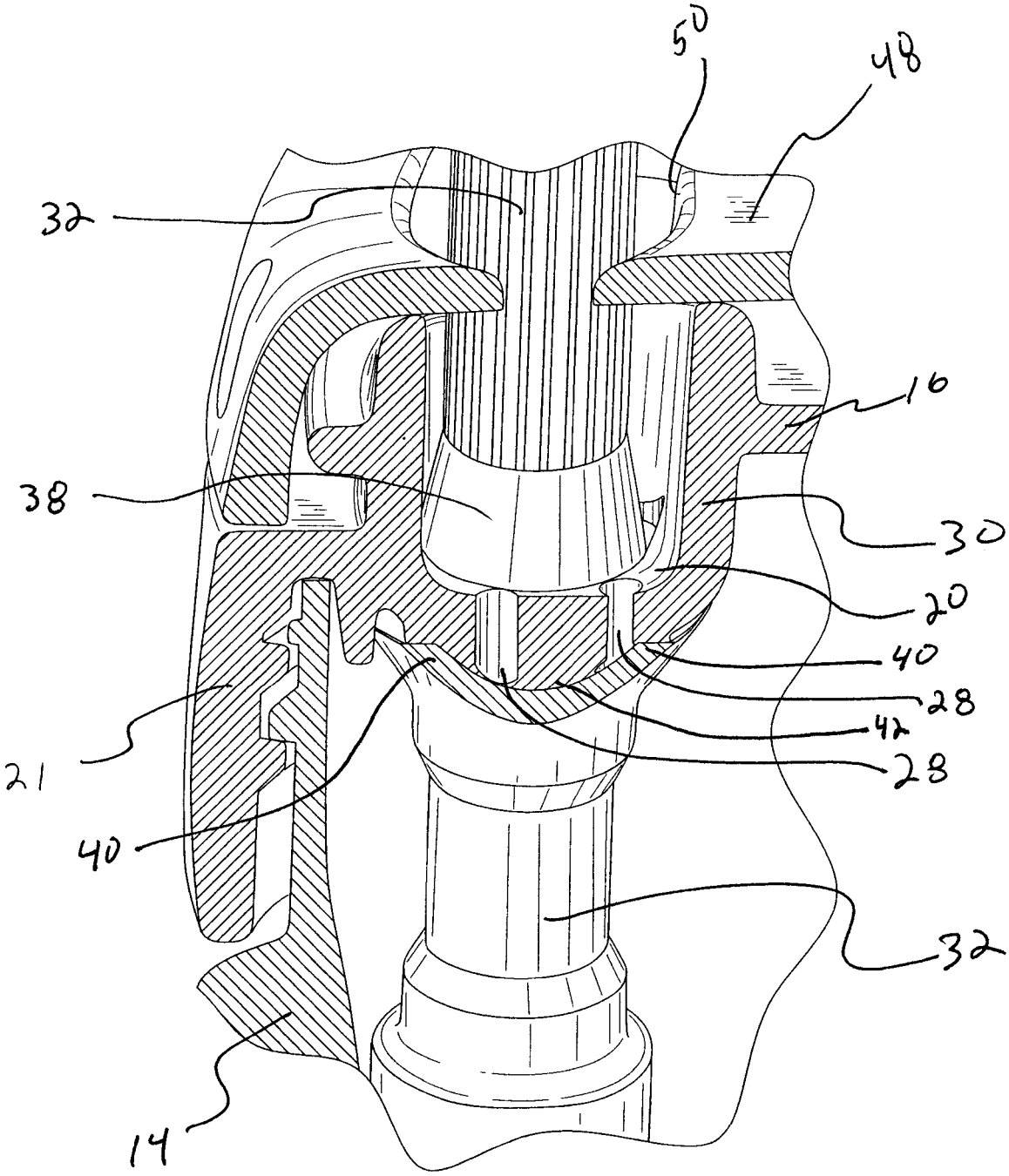
FIG. 4 is a perspective cross-sectional view of a portion of the vented closure shown in FIG. 1.

FIG. 4 shows the tube 32 extending through the closure body 16, within the bowl shaped section 30. The positioning of the bowl shaped section 30, adjacent the edge of the container 14 is also shown. Although the tube 32 is shown extending through the bowl shaped section 30, the tube may extend through any portion of the closure body 16. Also, neither the tube, nor the bowl shaped section 30, must be located adjacent the edge of the container 14.

Referring to FIGS. 2, 2*a* and 4, a radial flange 38 extends outwardly from the tube 32 and engages the outer surface 20 of the closure body 16. In the embodiment shown, the flange 38 has a flat bottom surface and is generally frusto-conical in shape. However, the flange 38 may have any shape, so long as it engages the outer surface 20 of the closure body 16. The flange 38 serves to restrict the movement of the tube 32 into the container 14. It is preferable, but not necessary, that the flange 38 be integrally formed with the tube 32. As mentioned with respect to FIG. 3, it is preferable that the flange 38 does not cover any part of the upper edge of the vents 28.

A flexible seal member 40 extends upwardly and outwardly from the tube 32 to engage the inner surface 18 of the closure body 16. An inner end 40*a* of the flexible seal member 40 is located along the tube 32 at a point on the tube 20 that spaced from the inner surface 18. The flexible seal member 40 extends, in an upward and outward direction to the inner surface 18, having a generally frusto-conical shape and defining hollow area 41 between the flexible seal member 40 and the tube 32. In the embodiment shown, the closure body 16 has a downwardly extending ridge 42 extending around the dispensing port 26, into the hollow area 41.

An outer end 40*a* of the flexible seal member 40 is engages the inner surface of the closure body 16, such that the location where the vents 28 extends through the inner surface 18 is located radially between the flexible seal member 40 and the tube 32. Although a frusto-conical shape is shown here, the flexible seal member 40 may have any shape that extends upwardly and outwardly, to cover the vents 28. By way of example, the flexible sealing member 40 need not extend entirely around the tube 32.

The outer end 40*a* of the flexible seal member 40 contacts the inner surface 18 in a generally liquid tight engagement. The flexible seal member 40 may also be biased against the inner surface 18, further serving to seal the container 14. It is preferable that if a bias exists, it is not too strong to allow the pressure inside the container 12 to reach a level that is far enough below the atmospheric pressure that it becomes difficult to withdraw fluid through the tube 32.

The flange 38 and the flexible seal member 40 are both wider than the dispensing port 26. Thus, the tube 32 is restricted from longitudinal movement through the port 26. Preferably, during construction, the tube 32 is slid upwardly through the dispensing port 26 until the flange 38 passes the outer surface 20 and the flexible seal member 40 engages the inner surface 18.

As shown best in FIG. 1, the bowl shaped section 30 of the closure body 16 is preferably adjacent to a channel 44, sized to accommodate the upper portion 32*a* of the tube 32. The channel 44 has a generally arcuate shape that is concentric with the outer circumference of the container 14. A sealing ridge 46 is located between the bowl shaped section 30 of the closure body 16 and the channel 44.

As seen best in FIGS. 1 and 4, a cap 48 is rotatably mounted on the closure body 10. An arcuate slot 50 extends through the cap 48 and is preferably of equal size and shape to the bowl shape section 30 of the closure 10 and the channel 44. The cap 48 is movable between an open position and a closed position. In the open position, the slot 50 is disposed above the bowl shaped section 30 and the channel 44, and the upper portion 32*a* of the tube 32 extends through the cap 48. When liquid is not being withdrawn from the container 14, the cap 48 is rotated into the closed position, where the slot 50 is moved away from the bowl shaped section 30 and the channel 44. When the cap 48 is closed the upper portion 32*a* of the tube 32 is forced down into the channel 44 and the tube 32 is squeezed between the ridge 42 and the bottom of the cap 48. By way of example, similar structures are shown in expired U.S. Pat. Nos. 5,150,815 and 5,361,934.

Figure 5:
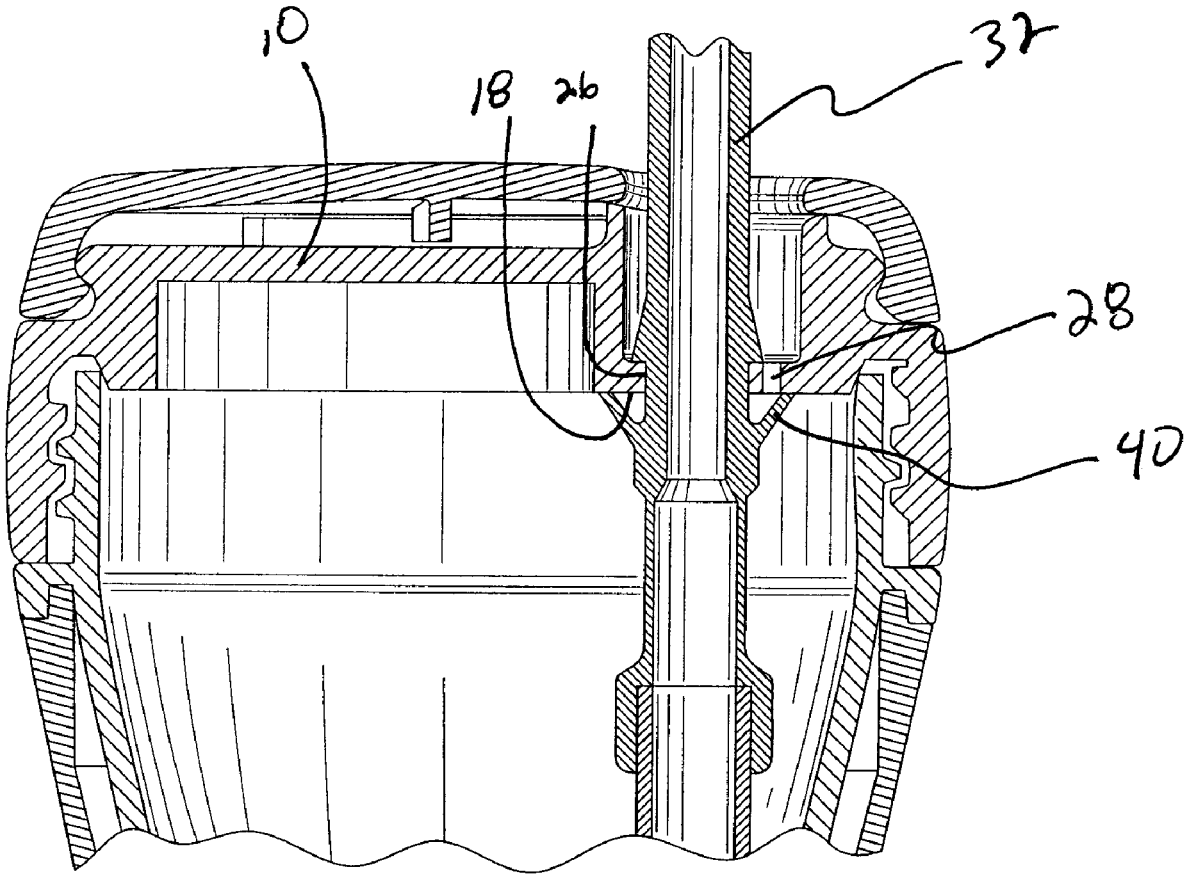
FIG. 5 is a cross-sectional view of a further embodiment of a vented closure according to the present invention.

FIG. 5 shows an alternative embodiment of a vented closure 10, having all of the above described features, except for the ridge 42 extending around the dispensing port 26 (shown in FIG. 2). As seen in FIG. 5, the closure body 10 may have a generally flat inner surface 18, proximate the dispensing port 26. The flexible seal member 40 contacts the inner surface 18, with the vent 28 located between the flexible seal member 40 and the tube 32. The absence of the ridge 42 allows the use of various During operation, liquid stored in the container 14 is withdrawn through the tube 32 as the result of a pressure differential across the valve 34. Specifically, liquid is withdrawn from the container 14 when the pressure inside of the container 14 is greater than the pressure in the upper portion 32*a* of the tube 32. This pressure differential may be the result of suction applied to the upper portion 32*a* of the tube 32, squeezing the container 14 or some other means, such as pumping air into the container 14.

Referring now to FIGS. 2 and 2*a*, the vents 28 serve to allow air into the container 14, while the flexible seal member 40 restricts the outward movement of liquid through the vents 28. Although the flexible seal member 40 is contacts the inner surface 18, over the vents 28 (as seen in FIG. 2), the flexible seal member 40 is sufficiently flexible to allow air into the container 14 when the pressure outside of the container 14 is greater than the pressure inside the container 14 (as seen in FIG. 2*a*). Air travels along the patent denoted by the arrow "A" through the vent 28, and between the outer end 40*b* of the flexible seal member 40 and the inner surface 18 of the closure body 16, into the container 14. As mentioned above, the flexible seal member 40 may have a bias towards the inner surface 18 that is sufficient to restrict the flow of liquid from the container 14, when the pressure inside the container 14 is greater than or equal to the pressure outside the container 14. When the container 14 is inverted, liquid in the container 14 presses the flexible seal member 40 against the closure body 16, thus further serving to liquid from exiting the container and cause unwanted leakage.

The vented closure 10 may be made of any rigid or semi-rigid material and various applications may require specific materials. By way of example, if the vented closure 10 is used for drink products, plastics may be desired. However, if the use is for industrial products, such as cleansers or other chemicals it may be desirable to have at least a portion of the dispensing container 10 constructed from metals, such as steel or aluminum. Combinations of these materials may also be used. Also, it is preferable that the tube is constructed of a resiliently flexible material such as a polymer or silicone.

Although the invention has been described and illustrated with respect to the exemplary embodiments thereof, it should be understood by those skilled in the art that the foregoing and various other changes, omissions and additions may be made therein and thereto, without parting from the spirit and scope of the present invention.

What is claimed is:

1. A closure for a liquid container comprising:

a closure body adapted to engage a liquid container, having an inner surface, an outer surface, a dispensing port extending through the body, and a vent extending through the body adjacent the dispensing port; and a tube extending through the dispensing port having a retaining flange extending laterally therefrom and engaging the outer surface of the body, wherein said tube further comprises a valve located inside the tube, constructed of a resiliently flexible material and said valve spanning the interior of the tube and comprising at least one slit extending there through, and a flexible seal member having a generally frusto-conical shape having an inner end of the flexible seal member located on the tube, spaced away from the inner surface, and an outer end of the flexible seal member spaced away from the tube and engaging the inner surface in a first position, such that the vent extends through the inner surface at a point radially between the tube and the outer end of the flexible seal member, the flexible seal member and the tube defining a hollow area therebetween, and the flexible seal member being movable, in response to a pressure differential across the vent, away from the tube and the inner surface to a second position, to allow the inflow of air through the vent and between the inner surface and the outer end of the flexible seal member, into the liquid container.

2. The vented closure according to claim 1, wherein the inner surface further comprises a downwardly extending ridge, sized to fit within the hollow area between the flexible seal member and the tube.

3. The vented closure according to claim 1, wherein the vent is generally parallel to the dispensing port.

4. The vented closure according to claim 1, the tube further comprising an outer portion extending outwardly from the closure body, the body further comprising a channel extending along the outer surface and sized to accommodate the outer portion of the tube.

5. A drinking container for liquids comprising:

a cup portion having an upper rim;

a vented closure releasably attachable to the upper rim and having a closure body having a dispensing port and a vent extending therethrough, the closure body having inner and outer surfaces; and a straw extending through the dispensing port having a flexible seal member, having an inner end spaced from the inner surface along the straw, extending radially outwardly and towards the inner surface of the closure body, the flexible seal member also having an outer end spaced away from a tube in the dispensing port and normally contacting the inner surface radially outwardly of the vent; and wherein said straw further comprises a valve located inside the straw, constructed of a resiliently flexible material and said valve spanning the interior of the straw and comprising at least one slit extending there through;

the flexible seal member and the straw defining a cavity therebetween; and the flexible seal member being movable radially outwardly and away from the inner surface, to allow the inward flow of air through the vent upon the introduction of a pressure differential across the vent where the pressure outside of the container is greater than the pressure inside of the container.

6. The drinking container according to claim 5, further comprising an outer flange extending from the straw and engaging the outer surface of the closure body.

7. The drinking container according to claim 5, the straw further comprising a valve therein.

8. The drinking container according to claim 5, wherein the flexible seal member has a frusto-conical shape and extends entirely around the circumference of the straw.

9. The drinking container according to claim 5, wherein the inner surface further comprises a downwardly extending ridge, sized to fit within the cavity between the flexible seal member and the straw.

10. A dispensing tube for a vented vessel having a vessel wall with inner and outer surfaces, a dispensing port extending through the vessel wall and a vent port extending through the vessel wall proximate the dispensing port, the dispensing tube comprising:

a flexible seal member extending from the tube towards the inner surface, the flexible seal member having a frusto-conical shape with a radial inner edge on the tube, spaced away from the inner surface, and a radial outer edge spaced radially away from the tube and normally engaging the inner surface with the vent extending through the inner surface at a point between the radial outer edge of the flexible seal member and the tube;

a radial flange extending outwardly from the tube and engaging the outer surface of the vessel wall;

the flexible seal member being movable in a radially outward direction and away from the inner surface to allow the inward flow of air through the vent and over the radial outer edge of the flexible seal member upon the introduction of a pressure differential across the vent where the pressure outside of the container is greater than the pressure inside of the container, and wherein said tube further comprises a valve located inside the tube, constructed of a resiliently flexible material and said valve spanning the interior of the tube and comprising at least one slit extending there through.

* * * * *